US011585063B2

(12) United States Patent
Pipsair

(10) Patent No.: US 11,585,063 B2
(45) Date of Patent: Feb. 21, 2023

(54) PILE STAGING STAND ASSEMBLY

(71) Applicant: Quanta Associates, L.P., Houston, TX (US)

(72) Inventor: Jonathan Pipsair, Pierre Part, LA (US)

(73) Assignee: Quanta Associates, L.P., Houston, TX (US)

( * ) Notice: Subject to any disclaimer, the term of this patent is extended or adjusted under 35 U.S.C. 154(b) by 0 days.

(21) Appl. No.: 17/343,028

(22) Filed: Jun. 9, 2021

(65) Prior Publication Data

US 2021/0388571 A1 Dec. 16, 2021

Related U.S. Application Data

(60) Provisional application No. 63/037,178, filed on Jun. 10, 2020.

(51) Int. Cl.
*E02D 13/04* (2006.01)

(52) U.S. Cl.
CPC ..... *E02D 13/04* (2013.01)

(58) Field of Classification Search
CPC ..... E02D 13/04; E02D 7/00
USPC ..... 405/232
See application file for complete search history.

(56) References Cited

U.S. PATENT DOCUMENTS 6,749,371 B2 * 6/2004 Jones ..... E02D 13/04 405/231
7,585,133 B2 * 9/2009 Jones ..... E02D 7/16 405/232
2009/0320385 A1 * 12/2009 Stoetzer ..... E02D 7/00 52/118
2014/0154015 A1 * 6/2014 Jung ..... E02D 13/005 405/184.1
2019/0218739 A1 * 7/2019 Gunter ..... E02D 13/04
2022/0081864 A1 * 3/2022 Pipsair ..... E02D 13/04

OTHER PUBLICATIONS

Simplex, Loadbinder Jacks Operational Manual Reference #-54215 Rev.-A, Jul. 1, 2011, 24 pages, Simplex, Westmont, IL, United States.
Simplex, SER10, SER20, SER30, SER40 Loadbinder Jack Repair Parts Sheet, Feb. 1, 2011, 1 page, Westmont, IL, United States.

* cited by examiner

*Primary Examiner* — Sean D Andrish
(74) *Attorney, Agent, or Firm* — Oathout Law Firm; Mark A. Oathout; Laura Tu

(57) ABSTRACT

The disclosure relates to an assembly for staging a pile on the ground, including: at least one stand having a mainframe assembly on the ground, having a front end and a rear end, wherein each stand has: a roller assembly slidably mounted on the main frame assembly, wherein the roller assembly further has a roller located towards the front end; and a pivoting arm assembly having a pivoting arm configured for pivoting towards the ground and away from the ground; and a second roller connected to an end of the pivoting arm.

3 Claims, 13 Drawing Sheets

PILE STAGING STAND ASSEMBLY

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Technical Field: The disclosure relates to the use of stands and stand assemblies for staging piles to increase safety, accuracy, efficiency and to minimize use of multiple cranes.

Conventional pile stands and stand assemblies are currently available to stage piles in order to ensure proper pile installation at the desired site. However, conventional pile stands and stand assemblies are large and cumbersome, and typically require the use of multiple cranes and work equipment in order to effectively use, move and manipulate the pile stand/stand assembly. The rental of a single crane is a large budget expense, and thus the requirement for multiple cranes is an undesirable feature of currently available conventional pile stands and stand assemblies. Therefore, a need exists for a pile staging stand and stand assembly which can minimize the need for multiple cranes, and also can be easily moved or manipulated around and out of a worksite.

SUMMARY

The disclosure relates to an assembly for staging a pile on the ground, including: at least one stand having a mainframe assembly on the ground, having a front end and a rear end, wherein each stand has: a roller assembly slidably mounted on the main frame assembly, wherein the roller assembly further has a roller located towards the front end; and a pivoting arm assembly having a pivoting arm configured for pivoting towards the ground and away from the ground; and a second roller connected to an end of the pivoting arm

BRIEF DESCRIPTION OF THE DRAWINGS

The exemplary embodiments may be better understood, and numerous objects, features, and advantages made apparent to those skilled in the art by referencing the accompanying drawings. These drawings are used to illustrate only exemplary embodiments, and are not to be considered limiting of its scope, for the disclosure may admit to other equally effective exemplary embodiments. The figures are not necessarily to scale and certain features and certain views of the figures may be shown exaggerated in scale or in schematic in the interest of clarity and conciseness.

DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
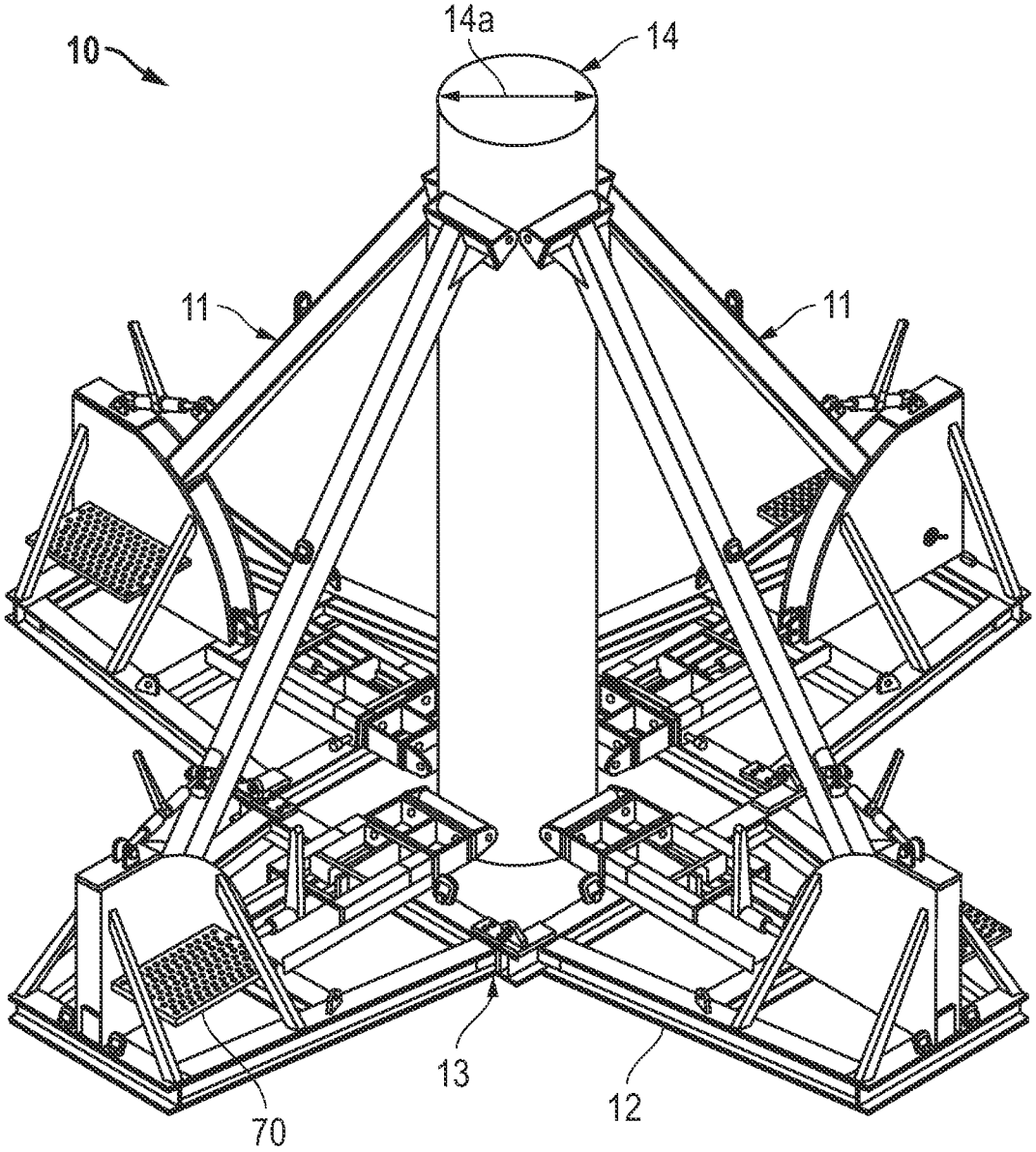
FIG. 1 depicts an isometric view of an exemplary embodiment of an improved pile staging stand assembly with a pile.
Figure 3:
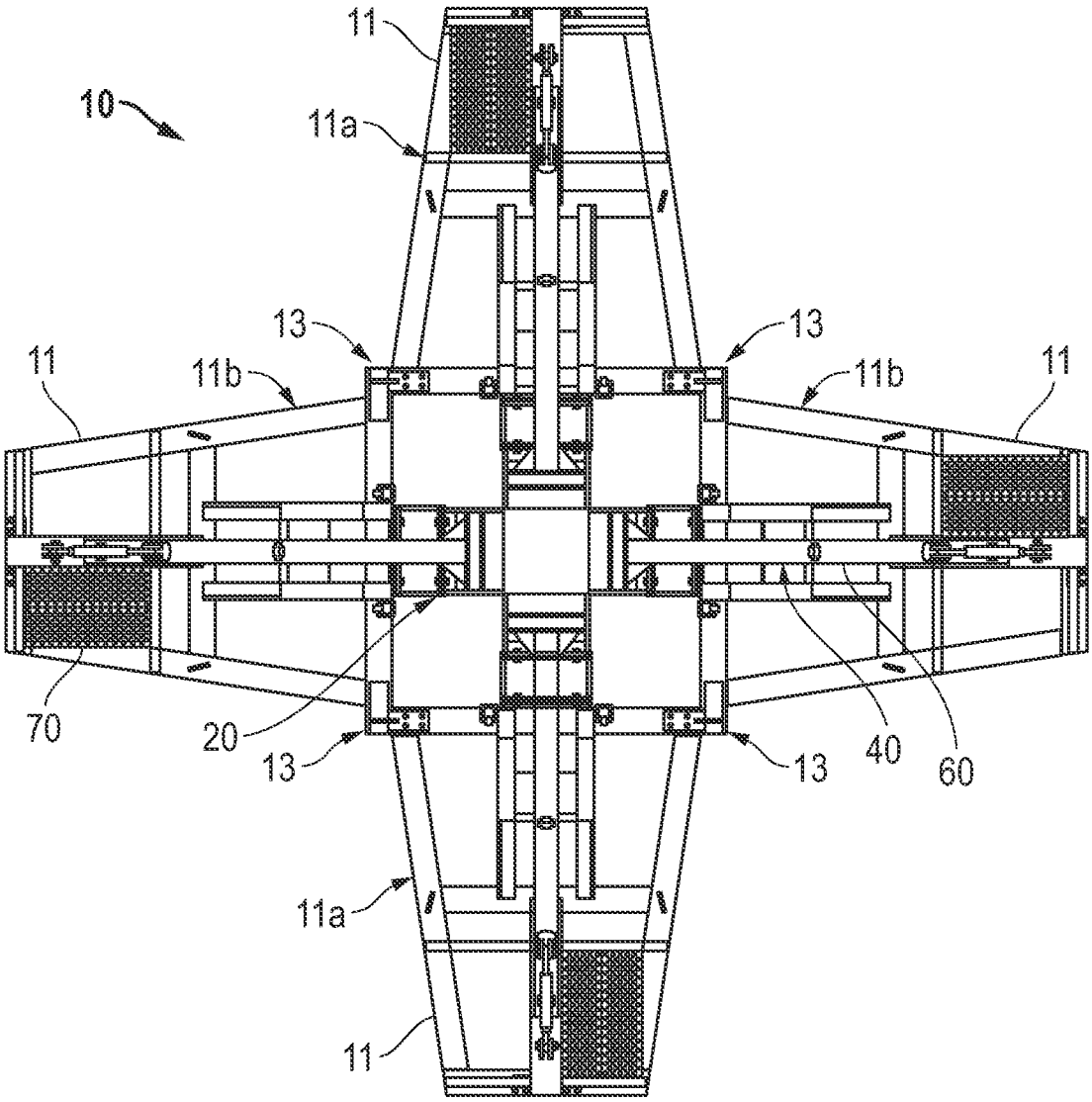
FIG. 3 depicts a top view of an exemplary embodiment of an improved pile staging stand assembly.
Figure 4:
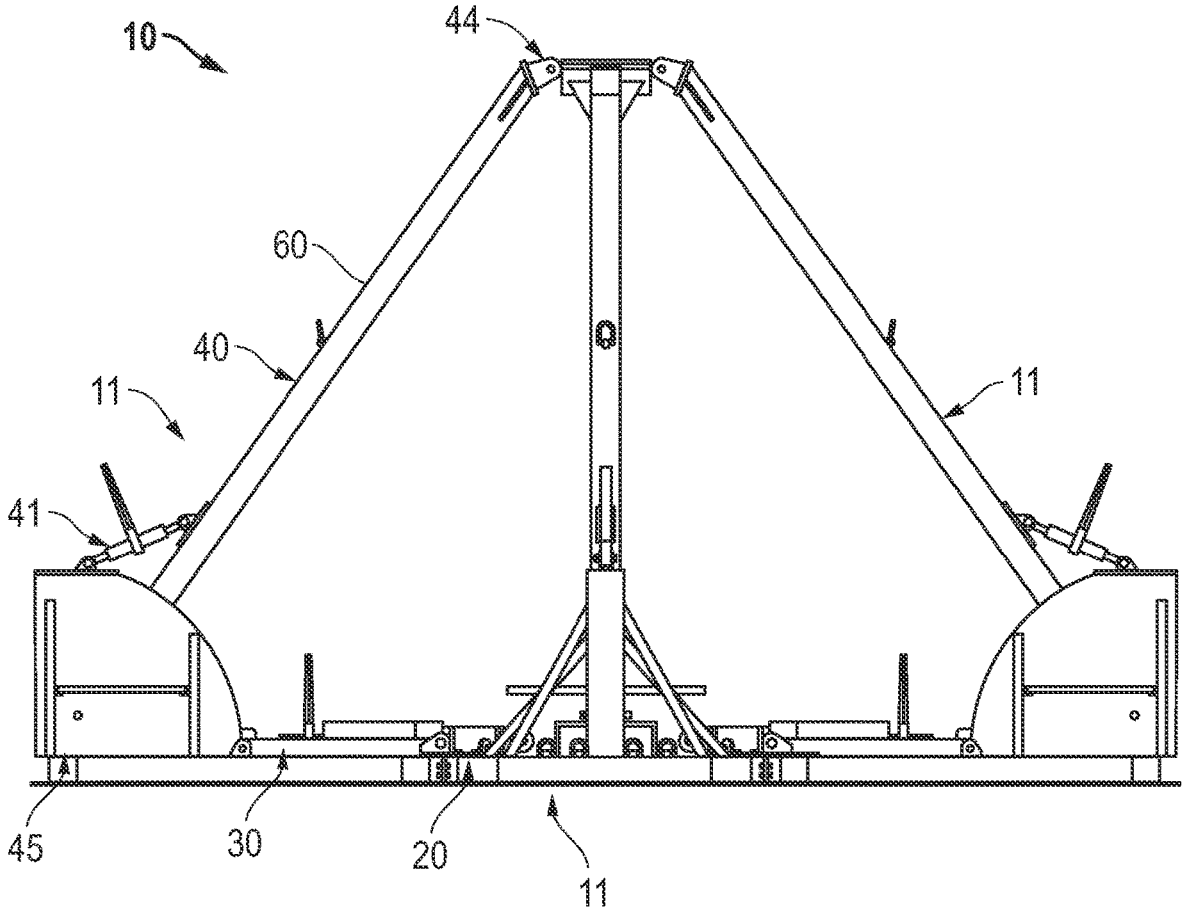
FIG. 4 depicts a side view of an exemplary embodiment of an improved pile staging stand assembly.

FIG. 1 depicts an isometric view of an exemplary embodiment of an improved pile staging stand assembly 10 with a pile 14. FIGS. 3 and 4 depict a top and side view, respectively, of the exemplary embodiment of the improved pile staging stand assembly 10 without the pile 14. Pile staging stand assembly 10 includes a plurality of pile staging stands 11 for surrounding a pile 14, wherein pile 14 may have a pile diameter or size 14*a*. The pile 14 may be located in or towards the center of the pile staging stands 11 when assembled as stand assembly 10. Each of the pile staging stands 11 may include a roller assembly 20, a spacer 30, a pivoting arms assembly 40, and a stepping grate 70 all mounted onto or connected with (directly or indirectly) a base or main frame (or mainframe) assembly or bottom bracket 12 of each stand 11. Each of the individual pile staging stands 11 and main frame assembly 12 has a front 17, a rear 18 (see e.g. FIGS. 5 and 9) and two sides 19. The pile staging stands 11 may be connected or secured to each other via fasteners 13 on each main frame assembly 12, towards the front 17 corners of each main frame assembly 12. Although the illustrated figures depict four connected pile staging stands 11 to form a pile staging stand assembly 10, the present disclosure includes within its scope any number of improved pile staging stands 11 to be connected, combined, or affixed together to form an improved pile staging stand assembly 10. By way of example only, one alternative exemplary embodiment may instead include three (3) connected pile staging stands 11 to form a pile staging stand assembly 10. Further, each pile staging stand 11 or arm 62 may optionally swivel, rotate, pivot, turn, or spin up (and/or rotate horizontally over/across the ground surface) to a range of 180 degrees along or across the ground, at rotatable or swivel point at one or more of front 17 corners, and/or in connection with one or more of the fasteners 13. By way of example only, the rotating or swiveling of the pile staging stand 11 or arm 62 may be accomplished via a bearing at the front 17 corners, or under or beneath the fasteners 13 towards the front 17 corners.

Figure 2:
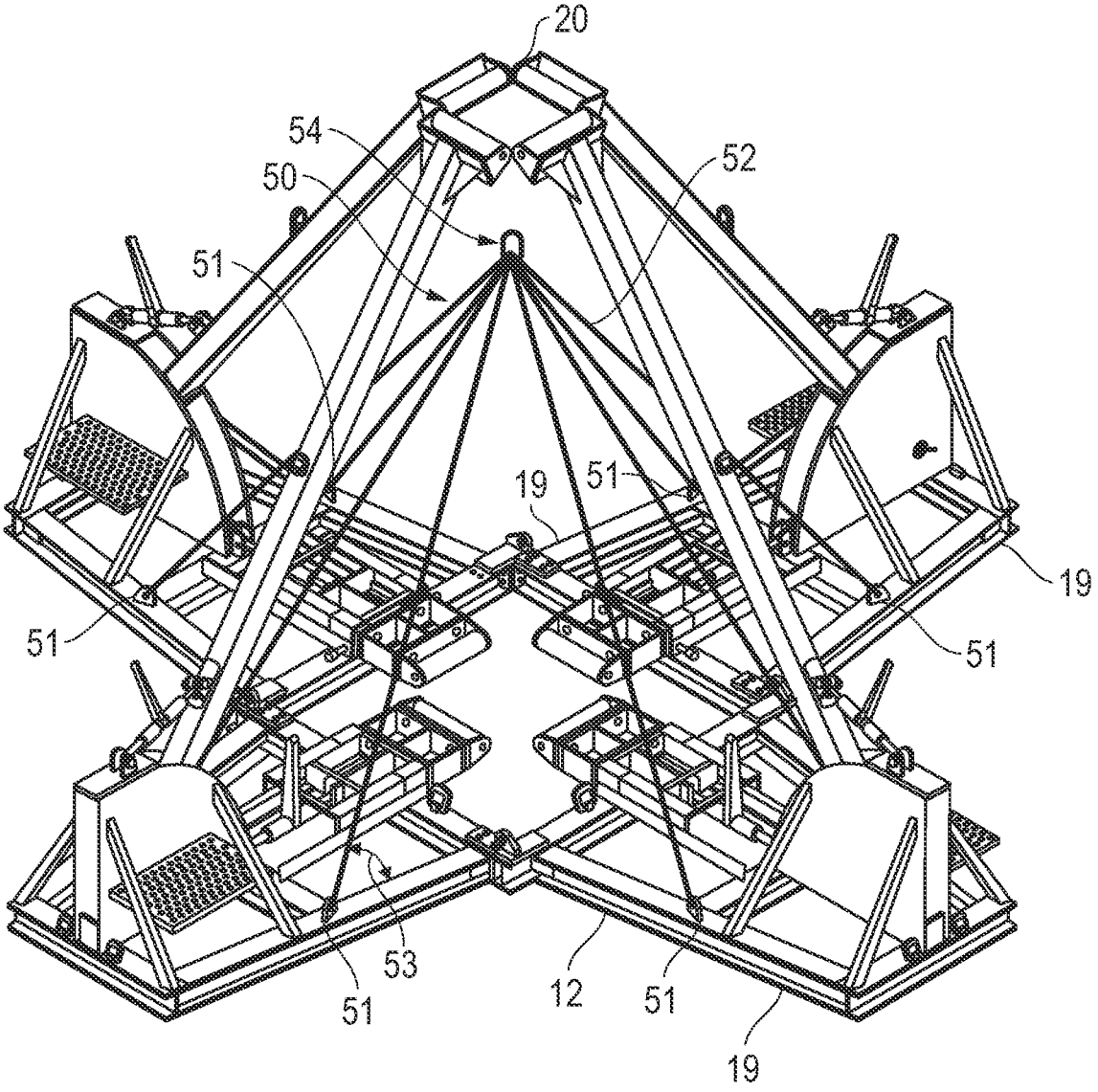
FIG. 2 depicts an isometric view of an improved lifting arrangement for a pile staging stand assembly.

The improved pile staging stand assembly 10 also includes an improved lifting arrangement 50, as depicted on FIG. 2. In the exemplary embodiment of the lifting arrangement of FIG. 2, the plurality of pile staging stands 11 are combined and joined together into the pile staging stand assembly 10 and are depicted with the pile 14 removed.

Each of the pile staging stands 11 may have at least one cable attachment fixture 51 secured to the base or main frame assembly 12 on the bottom of each stand 11. As illustrated in the exemplary embodiment of FIG. 2, the main frame assembly 12 may be defined as a substantially rectangular or trapezoidal shape, having a front 17, a rear 18, and two sides 19, wherein a cable attachment fixture 51 is secured along each of the sides 19 of each main frame assembly 12. In certain exemplary embodiments, the cable attachment fixture 51 may be a lug having an opening for connecting a cable 52. Cables 52 are then connected to each cable attachment fixture 51 and each cable 52 is joined at a lift attachment 54 towards the center of the pile staging stand assembly 10, above the main frame assembly 12. The lift attachment 54 may be, optionally, a loop or an eye structure allowing a hook to engage the lift attachment 54 and of sufficient strength to maintain the lifted weight of the pile staging stand assembly 10. Suitable machinery (such as a crane) can then efficiently move the entire structure of the pile staging stand assembly 10 via the lift attachment 54 without the need to disassemble or deconstruct the assembly 10 into individual pile staging stands 11. In a preferred exemplary embodiment, the load angle 53 of each cable 52 may be 45 degrees (when measured from the ground or main frame assembly 12 to the cable 52 as engaged at the lifting attachment 54).

Figure 5:
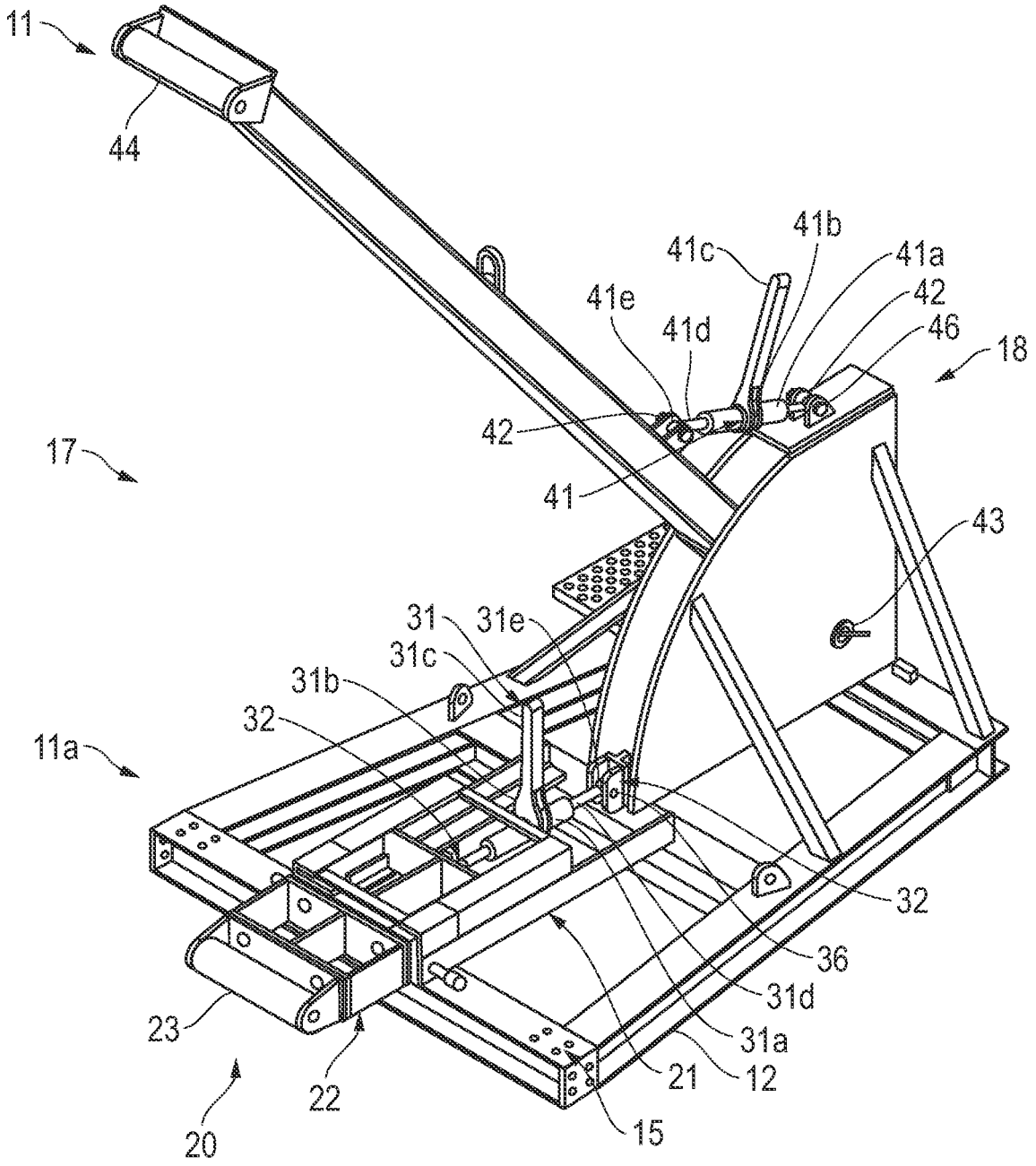
FIG. 5 depicts an isometric view of an exemplary embodiment of an improved pile staging stand.
Figure 6:
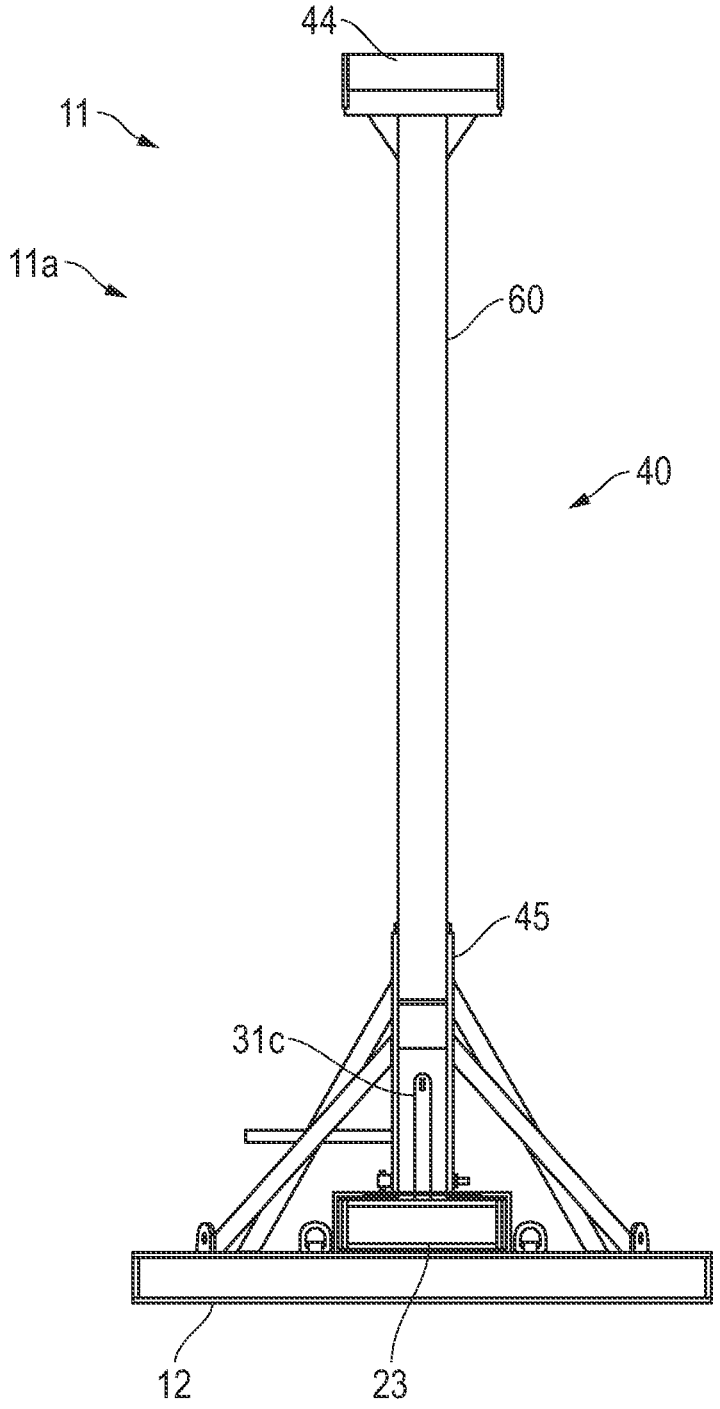
FIG. 6 depicts a front view of an exemplary embodiment of an improved pile staging stand.
Figure 7:
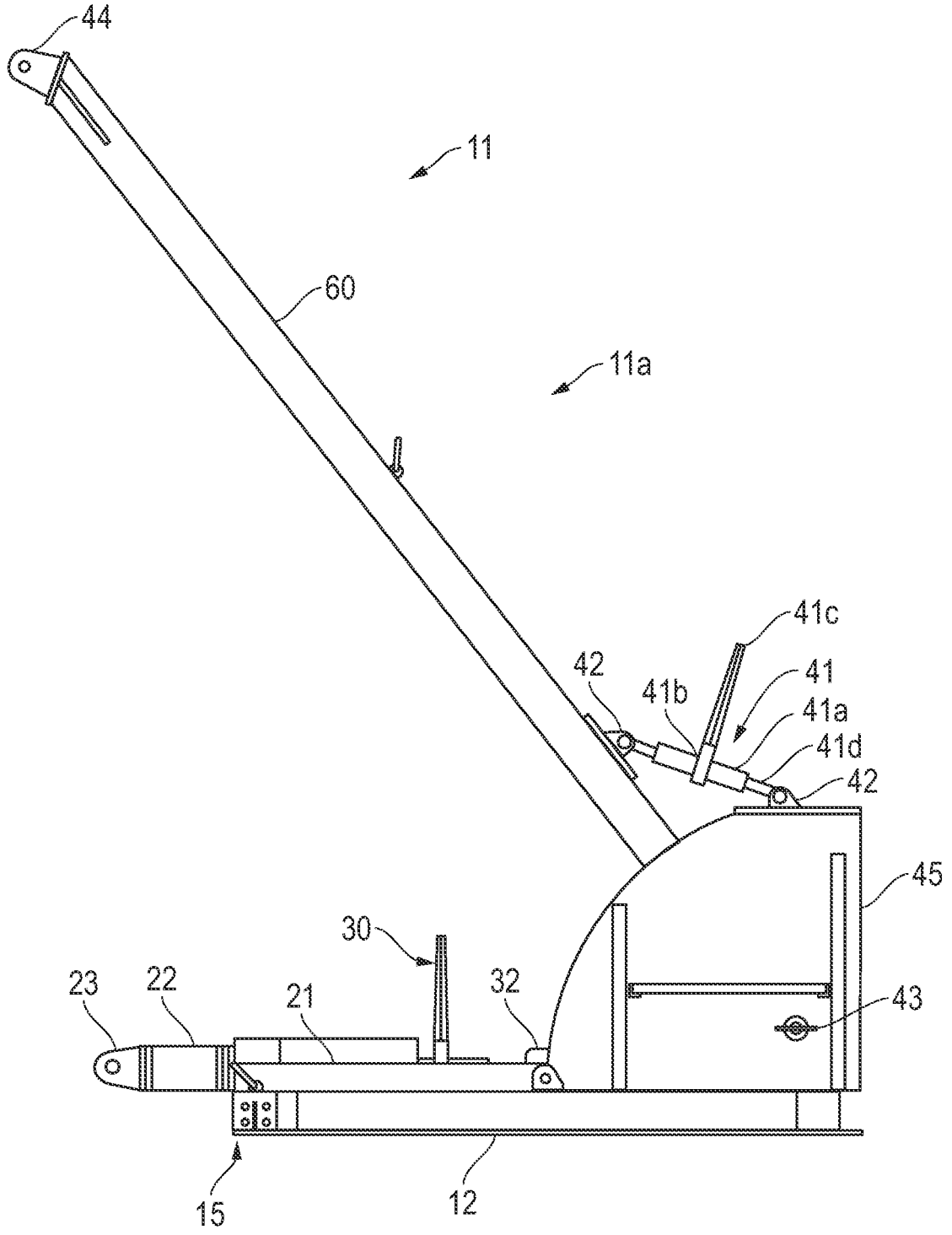
FIG. 7 depicts a side view of an exemplary embodiment of an improved pile staging stand.
Figure 8:
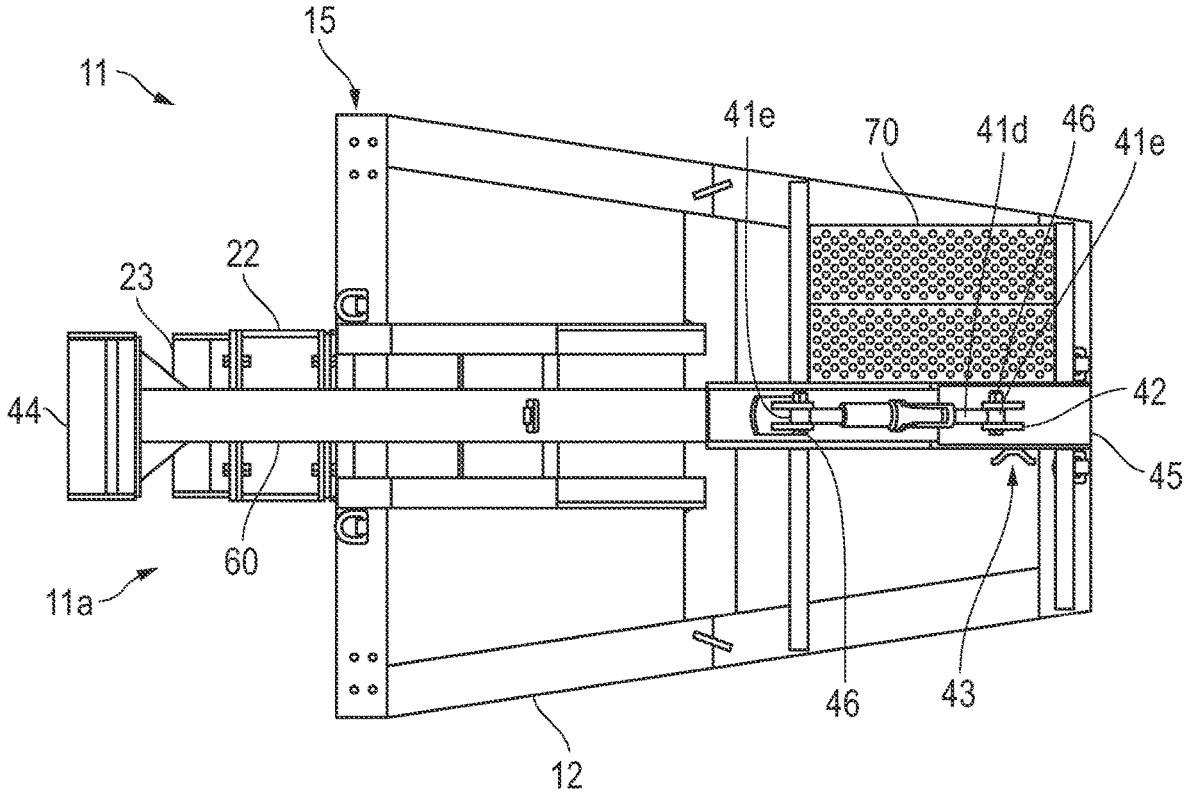
FIG. 8 depicts a top view of an exemplary embodiment of an improved pile staging stand.
Figure 9:
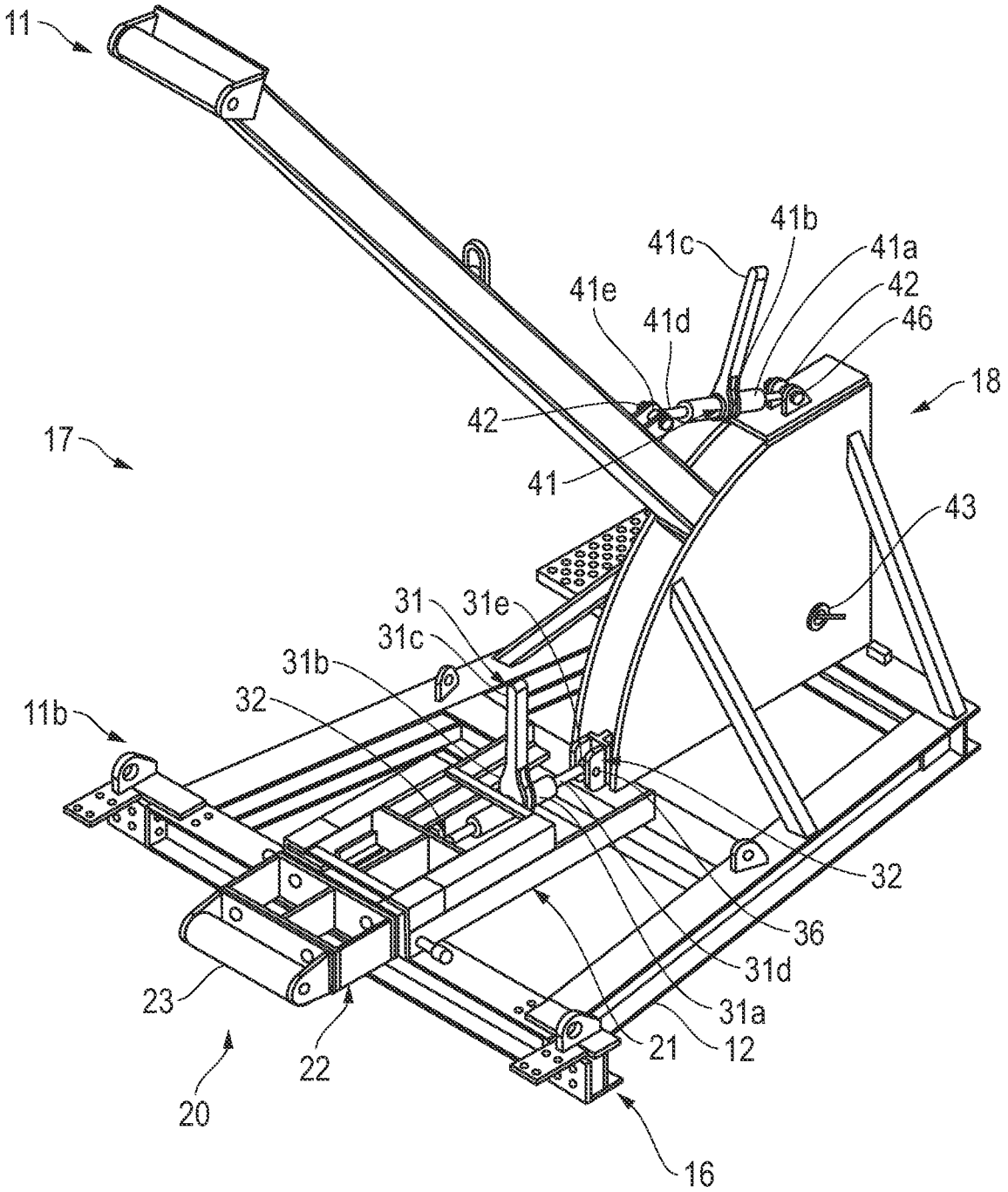
FIG. 9 depicts an isometric view of an alternative exemplary embodiment of an improved pile staging stand.
Figure 10:
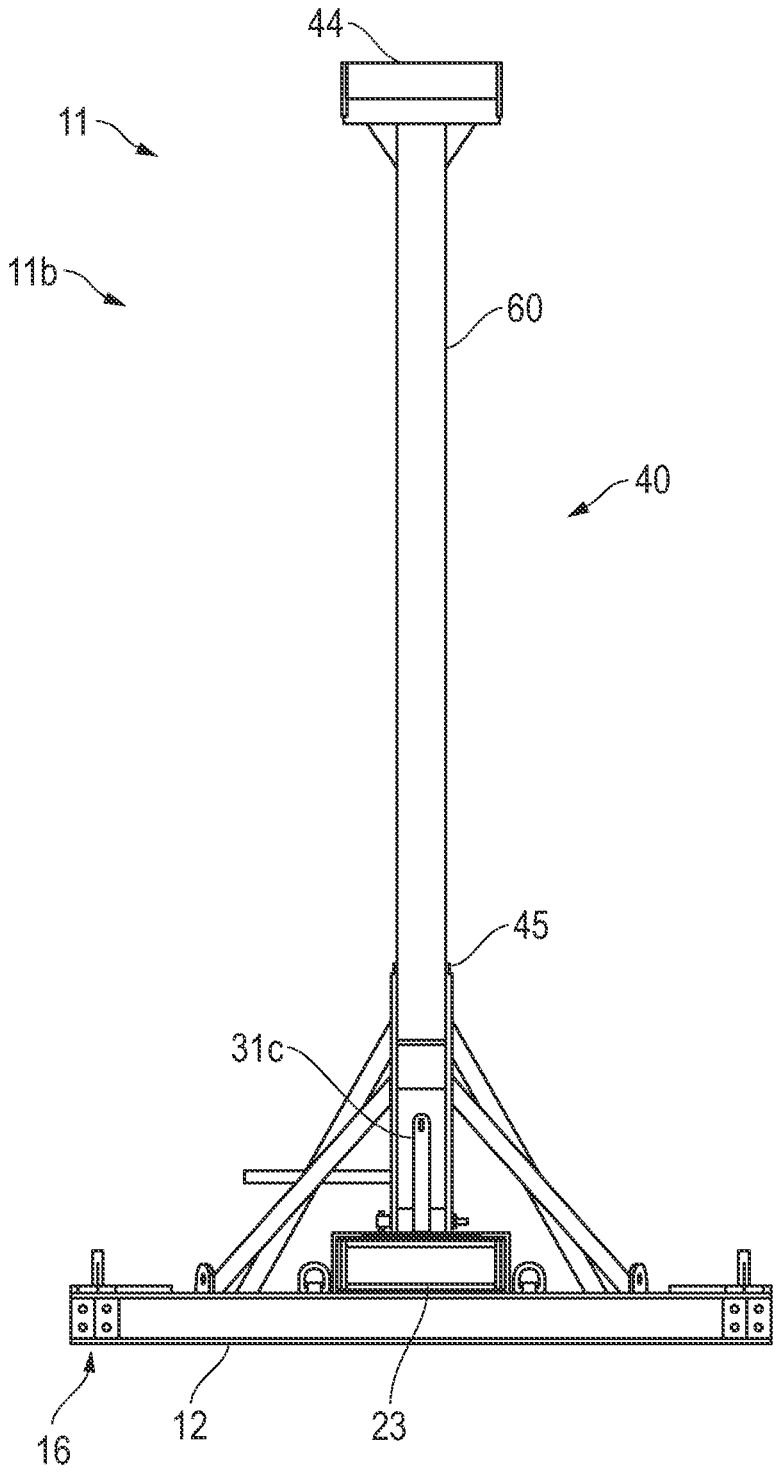
FIG. 10 depicts a front view of an alternative exemplary embodiment of an improved pile staging stand.
Figure 11:
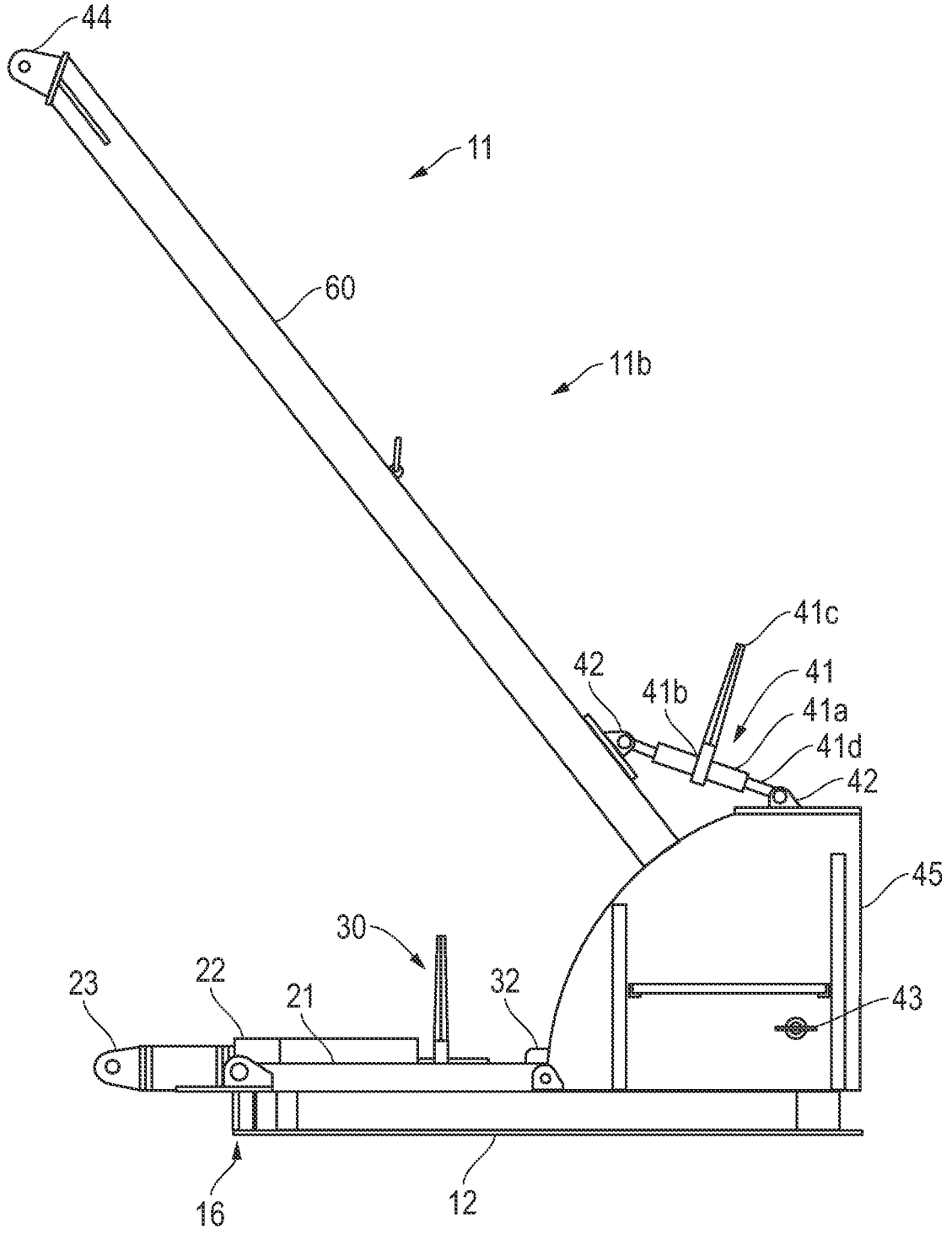
FIG. 11 depicts a side view of an alternative exemplary embodiment of an improved pile staging stand.
Figure 12:
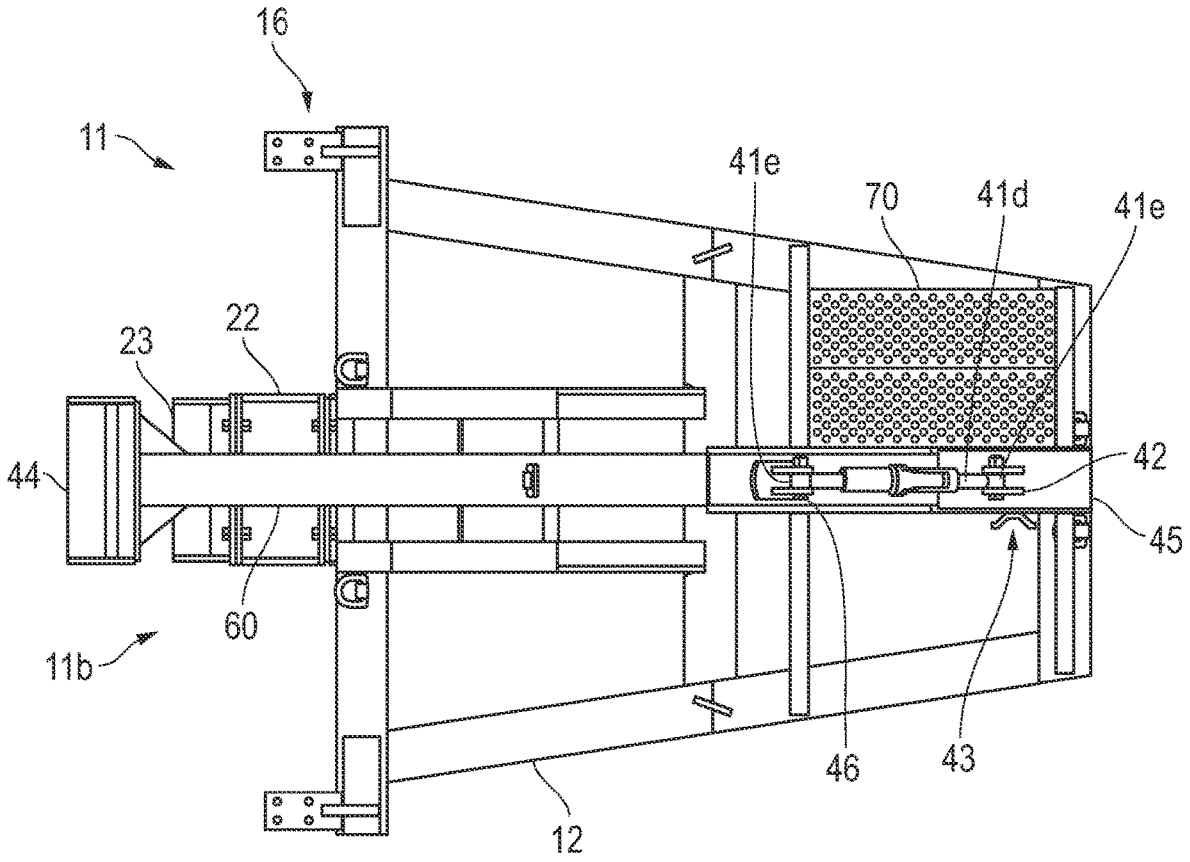
FIG. 12 depicts a top view of an alternative exemplary embodiment of an improved pile staging stand.

FIGS. 5 and 9 depict isometric views of two alternative exemplary embodiments of a pile staging stand 11. In FIG. 5, pile staging stand 11*a* has a fastener opening 15 at the front 17 corners of the main frame assembly 12 for fastening, securing, or engaging to or with pile staging stands 11*b* via fasteners 13. In FIG. 9, the exemplary embodiment of pile staging stand 11*b* includes a fastener bracket 16 at the front 17 corners of the main frame assembly 12, for fastening, securing, or engaging to pile staging stand 11*a* via fasteners 13. In all other aspects, pile staging stands 11*a* and pile staging stands 11*b* are substantially the same or similar. Thus, features described herein for the pile staging stands 11 are applicable to both pile staging stands 11*a* and 11*b* unless otherwise stated to be specific to either pile staging stand 11*a* and/or 11*b* (such as with regards to the fastener openings 15 and fastener brackets 16). FIGS. 6-8 depict further alternative views of the exemplary embodiment of pile staging stand 11*a* with the fastener openings 15, and FIGS. 10-12 depict further alternative views of the exemplary embodiment of the pile staging stand 11*b* with fastener brackets 16. As depicted in the exemplary embodiment FIG. 3, the pile staging stand assembly 10 may optionally include two pile staging stands 11*a* and two pile staging stands 11*b*, wherein each pile staging stand 11*a* is positioned diametrically across from the other pile staging stand 11*a*, and wherein each pile staging stand 11*b* is positioned diametrically across from the other pile staging stand 11*b*. Other combinations of stands 11 in a pile staging stand assembly 10, including using only stands 11*a* or 11*b*, or other stands 11 having the features disclosed, and securing with the appropriate fasteners 13 as known to one of ordinary skill in the art, are considered within the scope of this disclosure. As an example, three stands 11 may be arranged equidistantly around a pile 14 to securely hold pile 14 in place or position to drive pile 14 into the ground.

Referring to FIGS. 4-12, each pile staging stand 11 includes at least: a roller assembly 20, a spacer 30, a pivoting arms assembly 40, and a stepping grate 70, as mounted or secured onto a main frame assembly 12. The roller assembly 20 is located towards the front 17 of the main frame assembly 12. The pivoting arms assembly 40 is located towards the rear 18 of the main frame assembly 12. The spacer 30 is located between the roller assembly 20 and the pivoting arms assembly 40.

The roller assembly 20 includes an angle iron housing assembly 21, a sliding roller frame assembly 22, and a roller 23. The angle iron housing assembly 21 is secured to the main frame assembly 12. The sliding roller frame assembly 22 is slidably housed within the angle iron housing assembly 21, such that the sliding roller frame assembly 22 can move or slide laterally towards the front 17 and the rear 18 of the pile staging stand 11 along the tracks of the angle iron housing assembly 21 or as guided by the angle iron housing assembly 21. Furthermore, the roller 23 is attached at a first or front end of the sliding roller assembly 22 towards the front 17 end of the stand 11. The roller 23, when extended via the slider roller assembly 22, is able to engage or support different sizes 14*a* of pile 14 when multiple stands 11 are combined as stand assembly 10. In certain exemplary embodiments, the sliding roller assembly 22 and roller 23 may extend 14 inches, or more or less, or have a 14 inch extension, or more or less, beyond the front 17 of the main frame assembly 12 and angle iron housing 21. A spacer 30 is attached to the other, second or rear end of the sliding roller assembly 22.

The spacer 30 includes a spacer load binder assembly 31, spacer load binder assembly attachment fixtures 32, and spacer load binder assembly fasteners/bolts 36. The spacer load binder assembly 31 may be a commercially available load binder assembly, such as, by way of example, a SER-10 load binder jack from the brand manufacturer SIMPLEX. The spacer load binder assembly 31 includes at least: a spacer load binder assembly pipe barrel 31*a*, a spacer load binder assembly pawl/ratchet wheel 31*b*, a spacer load binder assembly lever/handle 31*c*, and spacer load binder assembly threaded or screw arms 31*d* which each end in spacer load binder assembly eyelets or clevis eyelets 31*e*. The pipe barrel 31*a* houses an arm or two threaded arms 31*d* which can extend out of and retract into the pipe barrel 31*a* ends. The pawl/ratchet wheel 31*b* is installed about the middle of the pipe barrel 31*a*. The handle 31*c* extends above from the pipe barrel 31*a* and engageably interacts with the pawl/ratchet wheel 31*b*. The operator can then manipulate the lever 31*c* with the pawl/ratchet wheel 31*b* to extend or retract the arm or threaded arms 31*d* out of and into the pipe barrel 31*a* as desired. The threaded arms 31*d* may move simultaneously or in tandem with each other. The two eyelet ends 31*e* of the arms 31*d* are secured to the load binder attachment fixtures 32 via load binder fasteners 36. In certain exemplary embodiments, fasteners 36 may optionally allow pivoting movement of the arms 31*d* and eyelets 31*e* about the axis defined by the fastener 36 while engaged with attachment fixture 32. In the exemplary embodiments as depicted, a first load binder attachment fixture 32 is secured to the rear end of the sliding roller frame assembly 22 and the second load binder attachment fixture 32 is secured to the main frame assembly 12. As the threaded arms 31*d* are manipulated by the operator via the handle 31*c* to extend out of the pipe barrel 31*a*, the sliding roller frame 22 and roller 23 extends out towards the front 17 of the pile staging stand 11. When the operator retracts arms 31*d* into the pipe barrel 31*a*, the sliding roller frame 22 and roller 23 retract towards the rear 18 and back into the angle iron housing assembly 21.

The pivoting arm assembly 40 includes at least: a pivoting arm 60, a pivoting arm housing 45, a pivoting arm roller 44, a pivoting arm pin 43, and a second or pivoting arm load binder assembly 41. The pivoting arm housing 45 is mounted or secured onto the main frame assembly 12, towards the rear of the stand 11 or main frame assembly 12. The pivoting arm housing 45 houses or contains a partial length of the pivoting arm 60, while allowing pivoting motion of the arm 60. The pivoting arm 60 extends out of the pivoting arm housing 45 and can pivot away from or down to the ground, or, in other words, move away from and towards the main frame assembly 12. The angle of the pivoting arm 60 is determined, modified, or changed by the pivoting arm load binder assembly 41, which can be operated substantially the same as described earlier for the spacer load binder assembly 31.

The pivoting arm load binder assembly 41 may also be a commercially available load binder assembly, such as, by way of example, a SER-10 load binder jack from the brand manufacturer SIMPLEX. The pivoting arm load binder assembly 41 includes at least: a pivoting arm load binder assembly pipe barrel 41*a*, a pivoting arm load binder assembly pawl/ratchet wheel 41*b*, a pivoting arm load binder assembly lever/handle 41*c*, and pivoting arm load binder assembly threaded or screw arms 41*d* which each end in pivoting arm load binder assembly eyelets or clevis eyelets 41*e*. The pipe barrel 41*a* houses the arm or two threaded arms 41*d* which can extend out of and retract into the pipe barrel 41*a* ends. The pawl/ratchet wheel 41*b* is installed about the middle of the pipe barrel 41*a*. The handle 41*c* extends above from the pipe barrel 41*a* and engageably interacts with the pawl/ratchet wheel 41*b*. The operator can then manipulate the lever 41*c* with the pawl/ratchet wheel 41*b* to extend or retract the arm or threaded arms 41*d* out of or into the pipe barrel 41*a* as desired. The threaded arms 41*d* may move simultaneously or in tandem with each other. The two eyelet ends 41*e* of the arms 41*d* are secured to the pivoting arm load binder assembly attachment fixtures 42 via pivoting arm load binder assembly load binder assembly fasteners/bolts 46. In certain exemplary embodiments, fasteners 46 may allow pivoting movement of the arms 41*d* and eyelets 41*e* about the axis defined by the fastener/bolt 46 while engaged with attachment fixture 42. In the exemplary embodiments as depicted, a first load binder attachment fixture 42 is secured to a point along the length of the pivoting or pivotable arm 60 and the second load binder assembly attachment fixture 42 is secured to the pivoting arm housing 45. As the arms 41*d* are manipulated by the operator via the handle 41*c* to extend out of the pipe barrel 41*a*, the pivoting arms 60 may pivot or angle more downwards or towards the main frame assembly 12 or ground. When the operator retracts arms 41*d* into the pipe barrel 41*a*, the pivoting or pivotable arms 60 may pivot or angle upwards or away from the main frame assembly 12 or ground.

The pivoting arm assembly 40 may further include a pivoting arm pin 43 which is insertable into the pivoting arm housing 45 and engageable with the pivoting arm 60, near or at an end of the pivoting arm 60. When inserted into and through the pivoting arm housing 45, the pivoting arm pin 43 may secure or fix an end of the pivoting arm 60 so that when the pivoting arm load binder assembly 41 is adjusted, the desired angle of the pivoting arm 60 can be set or fixed. Further, the end of the pivoting arm 60 opposite to pivoting arm pin 43 includes a roller 44 to engage or support the pile 14 when the stands 11 are assembled. Roller 44 is free to rotate against and along an outside surface of pile 14 at all times that pile 14 is moving, such as when pile 14 is being driven into the ground or Earth. In certain exemplary embodiments, rollers 44 may be substantially similar to rollers 23 of the roller assembly 20. The stepping grate 70 may be secured to the pivoting arm housing 45 or main frame assembly 12, and enables the operator to be able to reach the handle/lever 41*c* of the pivoting arm load binder assembly 41.

Figure 13:
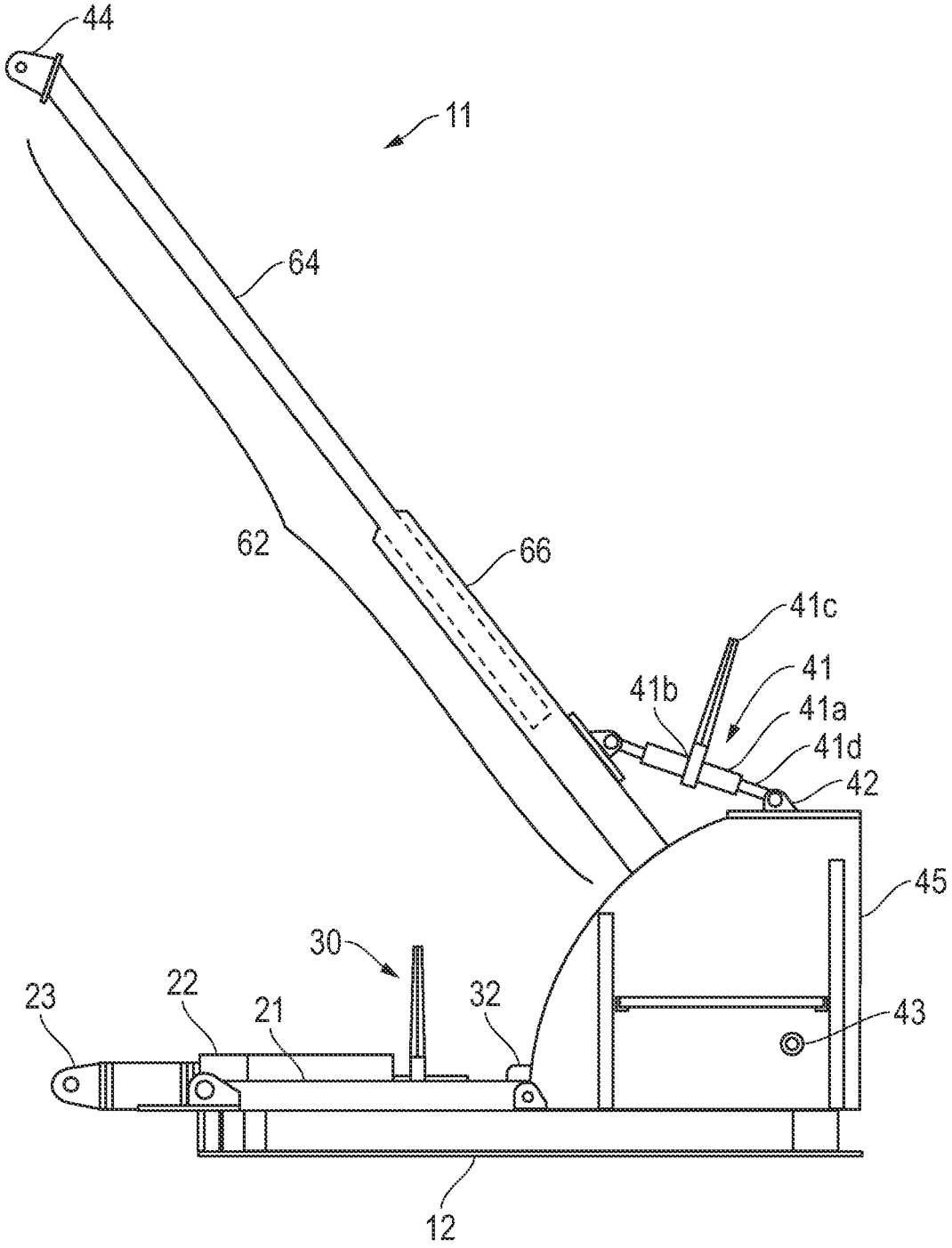
FIG. 13 depicts a side view of an alternative exemplary embodiment of an improved pile staging stand employing a telescoping pivoting arm.

FIG. 13 depicts another exemplary embodiment of each stand 11. More specifically, each of the pivoting arms on each stand 11 may also be a telescoping pivoting arm 62. When stand 11 employs a telescoping pivoting arm 62, the length of arm 62 can be variable such that the length of the telescoping pivoting arm 62 can be adjusted for length and set as desired by the operator. When a stand 11 is equipped with a telescoping pivoting arm 62, telescoping pivoting arm 62 is capable of extending and shortening to accommodate a variety of different piles 14, which includes a variety of lengths of each pile 14 and a variety of diameters 14*a* of pile 14. The telescoping pivoting arm 62 may have a smaller overall cross section arm 64 that is capable of moving into and out of a larger overall cross section arm 66. To move smaller overall cross section arm 64 into and out of larger overall cross section arm 66, a hydraulic system with hydraulic cylinders could be used, electric motors could be used, or mechanical pins could be used and passed through each of smaller overall cross section arm 64 and larger overall cross section arm 66 to achieve the overall desired length of telescoping pivoting arm 62. The pivoting arms 62 may optionally include electric cylinders for booming or telescoping the arms 62.

While the embodiments are described with reference to various implementations and exploitations, it will be understood that these embodiments are illustrative and that the scope of the inventive subject matter is not limited to them. Many variations, modifications, additions, and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. An assembly for staging a pile on the ground, comprising:

at least one stand having a mainframe assembly on the ground, having a front end and a rear end, wherein each stand comprises:

a roller assembly slidably mounted on the main frame assembly, wherein the roller assembly further comprises a first roller located towards the front end;

a first load binder assembly having two first load binder assembly arms, wherein each of the first load binder assembly arms are extendable and retractable and further wherein one of the first load binder assembly arms is connected to the roller assembly and the second of the first load binder assembly arms is connected to the main frame assembly;

a pivoting arm assembly connected to the mainframe assembly and comprising a pivoting arm configured for pivoting towards the ground and away from the ground;

a second roller connected to an end of the pivoting arm; and a second load binder assembly having two second load binder assembly arms, wherein each of the second load binder assembly arms are extendable and retractable, and further wherein one of the second load binder assembly arms is connected to the pivoting arm.

2. The apparatus of claim 1, wherein the first roller slides towards and away from the front end in response to the extension and retraction of the first load binder assembly arms, respectively.

3. The apparatus of claim 2, wherein the pivoting arm pivots towards and away from the ground in response to the extension and retraction of the second load binder assembly arms, respectively.

* * * * *